US005646473A

United States Patent [19]

Eggink et al.

[11] Patent Number: 5,646,473

[45] Date of Patent: Jul. 8, 1997

[54] ELECTRIC REFLECTOR LAMP

[75] Inventors: Hendrik J. Eggink; Winand H. A. M. Friederichs, both of Eindhoven, Netherlands

[73] Assignee: U.S. Philips Corporation, New York, N.Y.

[21] Appl. No.: 517,048

[22] Filed: Aug. 21, 1995

[30] Foreign Application Priority Data

Aug. 26, 1994 [EP] European Pat. Off. ..... 94202466

[51] Int. Cl.[6] ..... H01J 7/24

[52] U.S. Cl. ..... 313/113; 313/318.01

[58] Field of Search ..... 313/113, 318.01, 313/318.07, 318.08, 318.11

[56] References Cited

U.S. PATENT DOCUMENTS 4,829,210 5/1989 Benson et al. ..... 313/25
5,126,631 6/1992 Golz ..... 313/318.11
5,281,889 1/1994 Fields et al. ..... 313/113
5,466,981 11/1995 Fields et al. ..... 313/318.11

FOREIGN PATENT DOCUMENTS

0434292A2 6/1991 European Pat. Off. .
0543448 5/1993 European Pat. Off. .

*Primary Examiner*—Nimeshkumar Patel
*Attorney, Agent, or Firm*—Walter M. Egbert; Brian J. Wieghaus

[57] ABSTRACT

The electric reflector lamp has a molded reflector body having an optical axis. A neck is present around the axis. A light source is disposed in the reflector body, enveloped by a lamp vessel which has a seal. A metal mounting member through which the seal extends is present in the neck. The lamp has a ceramic body which surrounds the seal to lower the temperature during operation thereof. A mirroring disk may be present between the lamp vessel and the mounting member to reflect radiation away from the seal.

8 Claims, 2 Drawing Sheets

ELECTRIC REFLECTOR LAMP

BACKGROUND OF THE INVENTION

The invention relates to an electric reflector lamp comprising:

- a hollow moulded reflector body with an optical axis and a neck surrounding said optical axis;
- a lamp cap provided with contacts and connected to the neck;
- a light source which is arranged in the reflector body, is electrically connected to the contacts of the lamp cap by means of current conductors, and is accommodated in a lamp vessel having a seal;
- a metal mounting member in the neck which holds the lamp vessel and through which said seal of the lamp vessel is passed.

Such a reflector lamp is known from EP-A 0 543 448 (PHN 13.900).

The reflector body in the known reflector lamp is integral with the neck. The neck has a seat on which the mounting member bears. The mounting member is a plate through which the seal is passed and which has resilient tags which hold the seal of the lamp vessel with clamping force. The current conductors are fastened to a bottom of the neck under tension. Because of the thermal load and the ease of its manufacture, the reflector body is usually made of glass.

U.S. Pat. No. 5,281,889 discloses a reflector lamp whose neck is bipartite. The mounting member, again a plate with resilient tags which hold the seal with clamping force, is enclosed between the two parts of the neck.

U.S. Pat. No. 4,829,210 discloses a reflector lamp whose mounting member is a similar plate with resilient tags, but this plate has a flanged rim subdivided into resilient tags which rest with clamping force in the neck of the reflector body.

Such reflector lamps may be used as substitutes for incandescent lamps with blown glass bulbs for general lighting purposes or for such lamps having reflectorized blown bulbs. The reflector lamps may be operated at mains voltage and have Edison or bayonet caps. The intended application of the lamps implies that they must fit in conventional luminaires and that their necks must thus be comparatively long, corresponding to those of said lamps having blown bulbs.

The known reflector lamps have the advantage over conventional incandescent lamps that the light source is enclosed in an inner lamp vessel, and can thus have a higher brightness and a higher luminous efficacy, and can be more compact. As a result, the generated light can be shaped into a beam of comparatively high intensity in the centre thereof by the reflector body.

A disadvantage of these reflector lamps is, however, that the seal of the lamp vessel held by the mounting member assumes a comparatively high temperature during operation, although this seal is surrounded by a space inside the neck and in the direction of the lamp cap. The mounting member, however, closes off the space in the neck substantially from the space in the reflector body. A comparatively high temperature of said seal may limit lamp life. The current conductors in said seal may in fact oxidize comparatively quickly then, so that they cause the seal to crack.

SUMMARY OF THE INVENTION

It is an object of the invention to provide an electric reflector lamp of the kind mentioned in the opening paragraph whose lamp vessel seal has a comparatively low temperature during operation.

According to the invention, this object is achieved in that a ceramic body surrounding said seal of the lamp vessel is present in the neck.

It was found that the ceramic body leads to a major reduction in the temperature of the seal. This is quite remarkable in view of the fact that no narrow fits can be realised with ceramic bodies. The manufacture of ceramic bodies involves variations in their dimensions. The neck of the reflector body and the lamp vessel seal are also subject to variations in their dimensions. Ceramic material is rigid, not ductile, so that it cannot adapt itself to its surroundings. Even if the reflector body, the seal, and the ceramic body are manufactured with great care, they will generally not be in contact with one another everywhere around the optical axis, and interstices will exist at least locally. Nevertheless, the seal is found to have a lower temperature, i.e. there is an increased heat transfer from the seal to the surroundings thereof through the ceramic body at the neck compared with the situation in which said ceramic body is absent.

However, it is favourable when the ceramic body has a cavity for accommodating the seal with a shape which corresponds to the shape of the seal. The body can then closely surround the seal.

In a favourable embodiment, the ceramic body has a wall facing towards the lamp cap and transverse to the optical axis, in which wall a respective opening is provided for each current conductor.

In a special embodiment, the reflector lamp has a mirroring disc between the lamp vessel and the mounting member. The disc may be made, for example, of anodized aluminium. The advantage of this is that radiation from the light source is more strongly reflected, so that less heat is transferred to the lamp vessel seal. The material of the metal mounting member is in fact chosen on the basis of its mechanical properties, such as its resilience, rather than on the basis of its reflectivity during use at elevated temperature. The mounting member is made, for example, of stainless steel or German silver.

The reflector body may be moulded from glass, or may be formed from synthetic resin by, for example, pressing, casting, or injection-moulding. The reflector body may be closed off with a cover in the finished lamp, fastened thereto, for example, with cement. Pollution of the reflector may be counteracted thereby. The cover may alternatively have an optical function as well, for example, a beam-forming or smoothing function. A cover reduces the cooling of the lamp during operation, so that the measure in the lamp according to the invention is the more useful in the presence of a cover.

The lamp cap may be fastened to the reflector body in a conventional manner with, for example, glue or cement. In an attractive embodiment, however, the neck has one or several depressions into which the lamp cap is indented. Such depressions may be readily obtained without special provisions in the mould in that the reflector body is indented when coming out of the mould, while it is still hot.

The light source may be, for example, an incandescent body in a gas comprising halogen, or a pair of electrodes in an ionizable gas such as, for example, metal halides, rare gas, and possibly mercury.

BRIEF DESCRIPTION OF THE DRAWINGS

An embodiment of the electric reflector lamp is shown in the drawing, in which.

DESCRIPTION OF THE PREFERRED EMBODIMENTS

Figure 1:
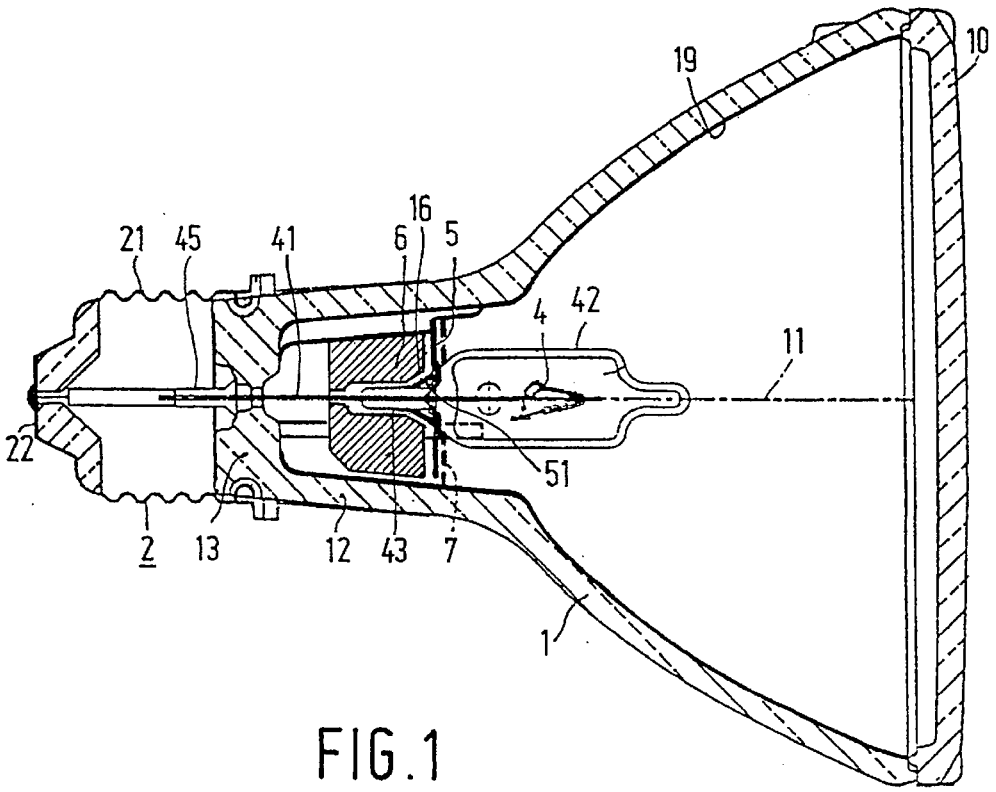
FIG. 1 shows a lamp in axial section.
Figure 2:
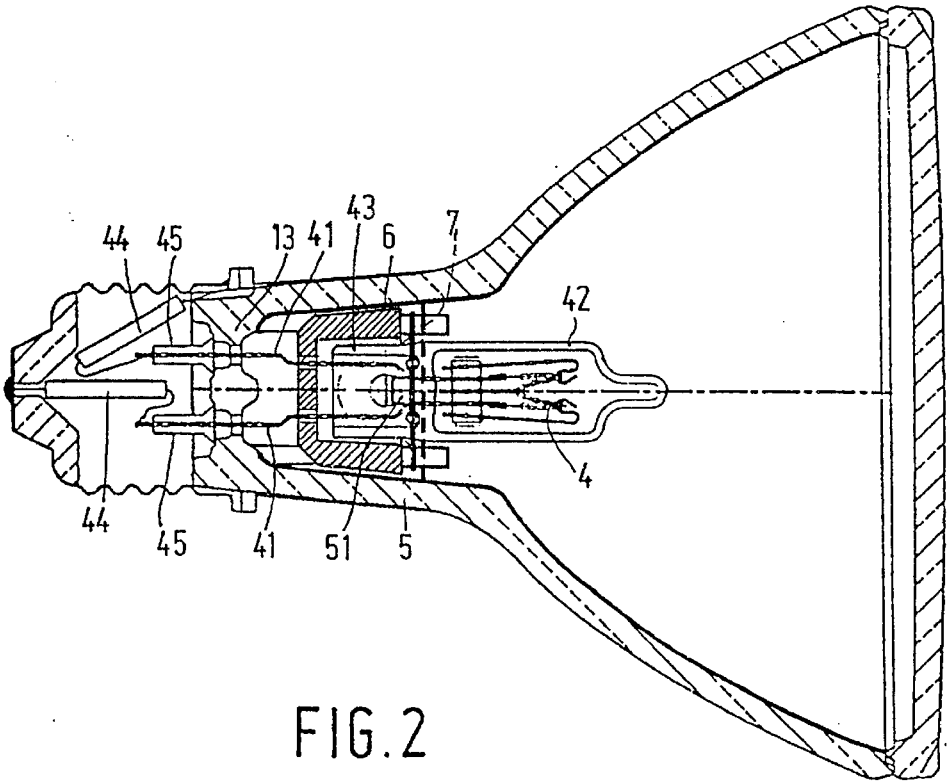
FIG. 2 shows the lamp of FIG. 1 rotated through 40°, in axial section.

In FIGS. 1 and 2, the electric reflector lamp has a hollow moulded reflector body 1, moulder from glass in the Figures, with an optical axis 11 and a neck 12 surrounding the optical axis. The reflector body has a mirror coating, for example internally, for example a vapour-deposited aluminium or silver layer 19, or alternatively an interference mirror. The reflecting surface is smoothly curved. Alternatively, however, it may be faceted or, for example, subdivided into axial lanes. The reflector body 1 shown is closed off with a cover 10, for example made of pressed glass, for example fixed with cement. A lamp cap 2, here an Edison lamp cap, is provided with contacts 21, 22 and connected to the neck. A light source 4 is arranged in the reflector body and electrically connected to the contacts of the lamp cap 2 by means of current conductors 41. The light source, an incandescent body in the Figures, is accommodated in a lamp vessel 42, for example made of quartz glass, which has a seal 43, for example a pinch seal, and which is filled with, for example, a rare gas and hydrogen bromide. In the neck 12 there is a metal mounting member 5 through which said lamp vessel seal 43 is passed and which holds the lamp vessel with resilient tags 51.

In the embodiment drawn, the neck 12 has a seat 16 on which the mounting member rests and which is formed by ridges in the neck. The current conductors 41 are fastened to a bottom 13 of the neck 12 under tension, in the Figures in that they are fixed in respective bushes 45, these bushes bearing on the bottom 13 on the side thereof facing towards the lamp cap 2. Safety fuses 44 are incorporated in the current conductors 4.

A ceramic body 6 which surrounds said seal 43 of the lamp vessel 42 is present in the neck 12.

A mirroring disc 7, for example made of aluminium, is indicated with a broken line as a component which may or may not be present.

Figure 3:
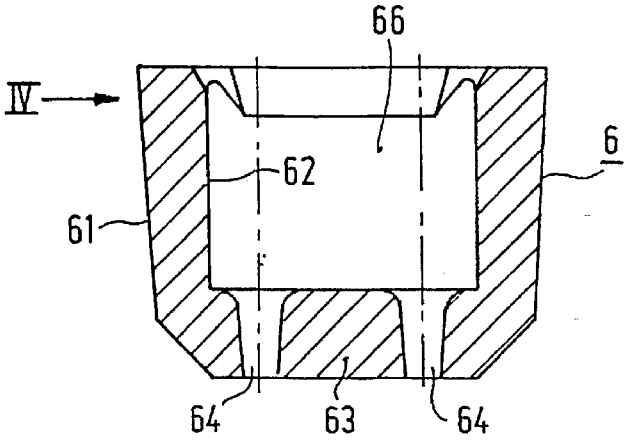
FIG. 3 shows the ceramic body as viewed in FIG. 2, on an enlarged scale.
Figure 4:
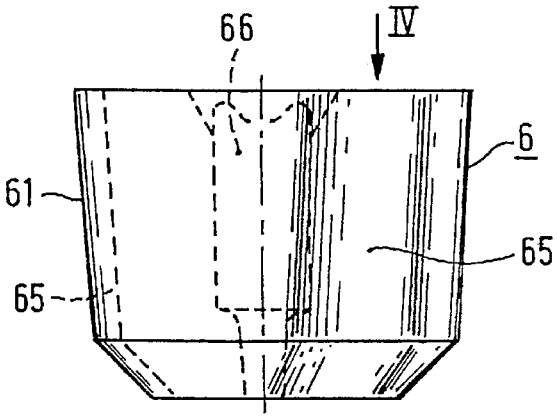
FIG. 4 shows the ceramic body taken on the line IV in FIG. 3.
Figure 5:
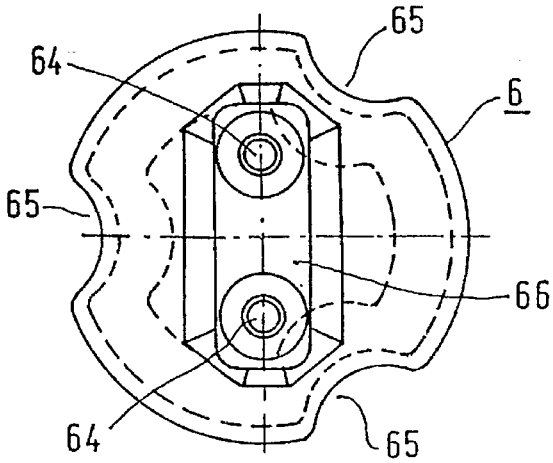
FIG. 5 shows the ceramic body taken on the line V in FIG. 4.

In FIGS. 3–5, the ceramic body 6, for example made of steatite, aluminium oxide, aluminium nitride, has a conical outer contour 61 so as to correspond to the inner shape of the neck 12. The inner contour 62 is slightly conical so as to disengage itself from the mold in which the body is formed. As clearly illustrated in FIGS. 1 and 2, a substantial portion of the molded ceramic body 6 is narrowly spaced from seal 43. As described above, such gaps are inherent in the manufacturing of ceramic material, whose rigidity prevents the formation of a narrow fit with adjoining parts. A wall 63 facing towards the lamp cap 2 (FIG. 2) has openings 64 for respective current conductors 41. The outer shell 61 has recesses 65 for accommodating ridges which form the seat 16 (FIG. 1) for the mounting member 5. The cavity 66 is destined for accommodating the seal of a lamp vessel.

A reflector lamp provided with a lamp vessel with an incandescent body of 75 W when operated at mains voltage was manufactured with a ceramic body comprising a cylindrical cavity for the lamp vessel seal which is rectangular in cross-section. A similar lamp had a ceramic body with a narrow rectangular cavity for the seal. For comparison, the lamp was also made without a ceramic body, and also without such a body but with a mirroring disc. The temperatures of the seal during lamp operation were measured and listed in Table 1.

TABLE 1

| ceramic body | disc | temp. °C. |
|---|---|---|
| — | – | 377* |
| — | + | 369* |
| cylindrical cavity | – | 235 |
| rectangular cavity | – | 184 |

*not according to the invention

It appears from this Table that a mirroring body reduces the temperature only slightly. The ceramic body with cylindrical cavity, which accordingly surrounds the rectangular seal at a distance for the major part, nevertheless reduces the temperature by 142° C. The ceramic body with the rectangular cavity, which narrowly encloses the seal, leads to an additional temperature reduction of 51° C.

The reflector lamp was also manufactured with a lamp vessel covered with an IR-reflecting interference filter. The incandescent body in the lamp vessel consumed a power of no more than 68 W when operated at mains voltage. The lamp was manufactured with and without a ceramic body with a rectangular cavity, and also with a ceramic body and a mirroring disc. The temperatures of the seal during operation are given in Table 2.

TABLE 2

| ceramic body | disc | temp. °C. |
|---|---|---|
| — | – | 583* |
| rectangular cavity | – | 408 |
| rectangular cavity | + | 381 |

It is apparent from Table 2 that the ceramic body reduces the seal temperature, which is considerably higher than that in Table 1 owing to the filter, by 175° C., while the mirroring disc leads to an additional temperature reduction of 27° C.

We claim:

1. An electric reflector lamp comprising:

a hollow molded reflector body with an optical axis and a neck surrounding said optical axis;

a lamp cap provided with contacts and connected to the neck;

a light source which is arranged in the reflector body, is electrically connected to the contacts of the lamp cap by means of current conductors, and is accommodated in a lamp vessel having a seal;

a metal mounting member in the neck which holds the lamp vessel and through which said seal of the lamp vessel is passed, characterized in that: a ceramic body surrounding said seal of the lamp vessel is present in the neck, such that a substantial portion of said ceramic body is narrowly spaced from said seal.

2. An electric reflector lamp as claimed in claim 1, characterized in that the ceramic body has a cavity for accommodating the seal whose shape corresponds to the shape of the seal.

3. An electric reflector lamp as claimed in claim 2, characterized in that the ceramic body has a wall facing towards the lamp cap and transverse to the optical axis, in which wall a respective opening is provided for each current conductor.

4. An electric reflector lamp as claimed in claim 3, characterized in that a mirroring disc is present between the lamp vessel and the mounting member.

5. An electric reflector lamp as claimed in claim 2, characterized in that a mirroring disc is present between the lamp vessel and the mounting member.

6. An electric reflector lamp as claimed in claim 1, characterized in that a mirroring disc is present between the lamp vessel and the mounting member.

7. An electric reflector lamp as claimed in claim 1, characterized in that the ceramic body has a wall facing towards the lamp cap and transverse to the optical axis, in which wall a respective opening is provided for each current conductor.

8. An electric reflector lamp as claimed in claim 7, characterized in that a mirroring disc is present between the lamp vessel and the mounting member.

* * * * *